US009062544B2

(12) United States Patent
Landsiedel

(10) Patent No.: US 9,062,544 B2
(45) Date of Patent: Jun. 23, 2015

(54) FORMATION FRACTURING

(75) Inventor: Nathan Landsiedel, Fresno, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 136 days.

(21) Appl. No.: 13/297,870

(22) Filed: Nov. 16, 2011

(65) Prior Publication Data

US 2013/0118751 A1 May 16, 2013

(51) Int. Cl.
*E21B 43/26* (2006.01)
*E21B 33/124* (2006.01)

(52) U.S. Cl.
CPC ..... *E21B 43/26* (2013.01); *E21B 33/1246* (2013.01); *E21B 33/124* (2013.01); *E21B 33/1243* (2013.01)

(58) Field of Classification Search
CPC ..... E21B 33/124; E21B 33/1243; E21B 33/1246; E21B 43/26
USPC ..... 166/264, 308.1, 374, 187, 191, 177.5, 166/118; 175/59
See application file for complete search history.

(56) References Cited

U.S. PATENT DOCUMENTS 4,353,249 A * 10/1982 Lagus et al. ..... 73/152.41
4,442,895 A * 4/1984 Lagus et al. ..... 166/250.1
4,453,595 A 6/1984 Lagus et al.
4,547,691 A 10/1985 Valdois et al.
4,860,581 A 8/1989 Zimmerman et al.
4,936,139 A * 6/1990 Zimmerman et al. ..... 73/152.26
5,165,274 A 11/1992 Thiercelin
5,295,393 A * 3/1994 Thiercelin ..... 73/152.51
5,353,637 A 10/1994 Plumb et al.
5,394,345 A 2/1995 Berard et al.
5,517,854 A 5/1996 Plumb et al.
5,799,733 A 9/1998 Ringgenberg et al.
6,076,046 A 6/2000 Vasudevan et al.
6,705,398 B2 3/2004 Weng
7,296,462 B2 * 11/2007 Gregory et al. ..... 73/152.51
7,594,541 B2 9/2009 Ciglenec et al.
8,015,869 B2 * 9/2011 Nold et al. ..... 73/152.51
2009/0044951 A1 2/2009 Milkovisch et al.
2010/0206548 A1 8/2010 Pisio et al.
2011/0067870 A1 3/2011 East, Jr.

FOREIGN PATENT DOCUMENTS

EP 522628 A2 1/1993

OTHER PUBLICATIONS

International Search Report & Written Opinion issued in PCT/US2012/064096 on Mar. 26, 2013; 9 pages.

* cited by examiner

*Primary Examiner* — Jennifer H Gay
*Assistant Examiner* — George Gray
(74) *Attorney, Agent, or Firm* — Cathy Hewitt; Kenneth Kincaid

(57) ABSTRACT

A method described herein involves lowering a tool into a wellbore adjacent a subterranean formation and inflating a first packer on the tool to initiate a fracture of the formation. The method also includes inflating second and third packers on the tool to seal an interval of the wellbore containing the fracture where the first packer is located between the second and third packers. The method further includes pumping fluid into the interval to increase a pressure in the interval to propagate the fracture.

20 Claims, 5 Drawing Sheets

FORMATION FRACTURING

BACKGROUND OF THE DISCLOSURE

Fracturing of subterranean formations involves positioning a downhole tool in a borehole adjacent a formation, sealing an interval of the borehole along the tool and adjacent the formation, increasing a fluid pressure in the sealed interval, and monitoring the fluid pressure. The pressure levels to initiate and propagate a fracture can be used determine geomechanical characteristics of the formation such as described in U.S. Pat. Nos. 5,165,274, 5,353,637, 6,076,046, or 6,705,398, all of which are incorporated herein by reference in their entireties. The geomechanical characteristics of the formation may then be utilized to design drilling and/or hydrocarbon production operations. Further, formation sampling operations and, more generally, fluid production from or injection into a formation may be facilitated by fracturing the formation within the sealed interval prior to extracting or injecting fluids.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
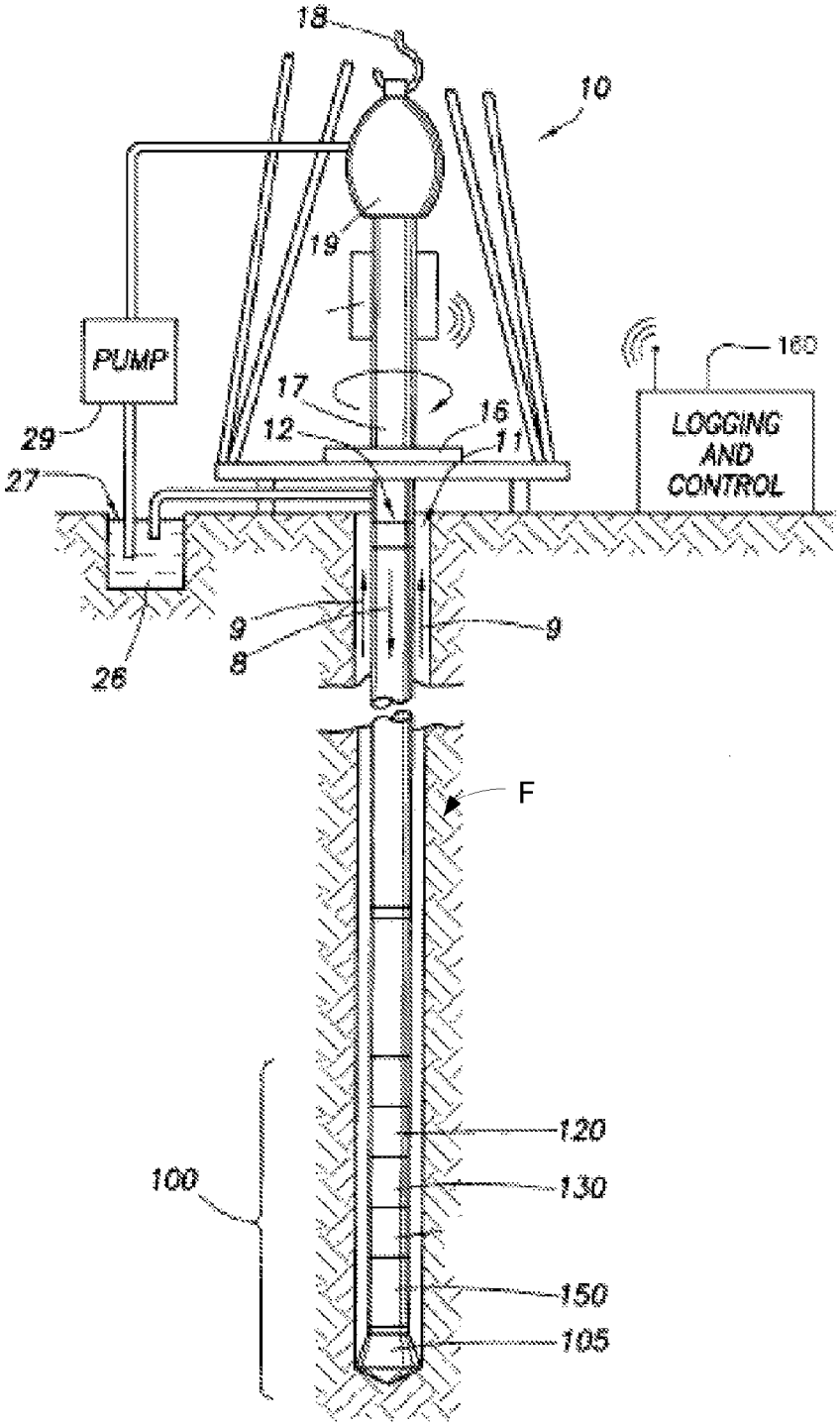
FIG. 1 illustrates an example drilling wellsite system in which embodiments of formation fracturing can be implemented.

It is to be understood that the following disclosure provides many different embodiments or examples for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features such that the first and second features may not be in direct contact.

One or more aspects of the present disclosure relate to apparatus and methods to fracture a formation. The examples described herein may lower a tool into a wellbore to be in a location adjacent a formation to be fractured. A packer or multiple packers of the tool may then be inflated to mechanically initiate a fracture of the formation with the tool in the location (i.e., without moving the tool relative to the formation or from the location). At least two additional packers may then be inflated to seal an interval of the wellbore containing the fracture with the tool in the location, and a fluid (e.g., a visco-elastic surfactant) may then be pumped into the interval to increase a pressure in the interval to hydraulically propagate the fracture.

The examples described herein may use a tool having at least three packers distributed along the body of the tool and at least one fluid port located on the body of the tool between at least the two outermost packers. In operation, the tool is lowered into a wellbore via a wireline, a drill string, or any other conveyance to be in a location adjacent a formation, and a packer located between the two outermost packers may be inflated to apply a force to the formation wall to mechanically initiate a fracture of the formation. With the tool in the same location, the outermost packers may then be inflated to seal an interval of the wellbore containing the fracture, and a fluid may be pumped via at least one fluid port into the sealed interval to increase the pressure in the interval to open or propagate the fracture. Alternatively, the outermost packers may be inflated prior to or simultaneously with the middle packer(s) to an appropriate inflation pressure for sealing and the middle packer(s) may then be further inflated to a pressure sufficient to initiate the fracture.

Some examples described herein include three packers, while other examples include three packers and a dummy packer, or four packers. In the case of a tool including four packers, one or both of the inner packers located between the two outermost packers may be inflated to mechanically initiate the fracture of a formation. Further, the examples described herein may use more than one fluid port to pump fluid into a sealed interval to increase the pressure in the interval to hydraulically propagate the fracture initiated by the inner packers. The fluid ports may include a sample port that may, for example, be located approximately centrally along the tool between the two outermost packers and/or one or more guard ports which, in the case of a four packer example implementation, may be located outside of the interval defined by the two innermost packers. Still further, the examples described herein may inflate the two outermost packers, and then increase the pressure in the sealed interval before initiating the fracture in the formation. Initiating the fracture may involve inflating both of the inner packers and increasing the pressure between the inner packers. Other sequences of interval sealing, interval pressurizing and fracture initiation by packer inflation are within the scope of the present disclosure.

FIG. 1 depicts a wellsite system including downhole tool(s) according to one or more aspects of the present disclosure. The wellsite system of FIG. 1 can be employed onshore and/or offshore to form a borehole 11 in one or more subsurface formations by rotary and/or directional drilling.

As illustrated in FIG. 1, a drill string 12 is suspended in the borehole 11 and includes a bottom hole assembly (BHA) 100 having a drill bit 105 at its lower end. An example surface system includes a platform and derrick assembly 10 positioned over the borehole 11. The platform and derrick assembly 10 includes a rotary table 16, a kelly 17, a hook 18 and a rotary swivel 19. The drill string 12 is rotated by the rotary table 16, energized by means not shown, which engages the kelly 17 at an upper end of the drill string 12. The drill string 12 is suspended from the hook 18, which is attached to a traveling block (not shown), and through the kelly 17 and the rotary swivel 19, which permits rotation of the drill string 12 relative to the hook 18. A top drive system may also be used.

In the example depicted in FIG. 1, the surface system further includes drilling fluid 26, which is also commonly referred to in the industry as mud, and which is stored in a pit 27 formed at the wellsite. A pump 29 delivers the drilling fluid 26 to the interior of the drill string 12 via a port in the rotary swivel 19, causing the drilling fluid 26 to flow downwardly through the drill string 12 as indicated by the directional arrow 8. The drilling fluid 26 exits the drill string 12 via ports in the drill bit 105, and then circulates upwardly through the annulus region between the outside of the drill string 12 and the wall of the borehole 11, as indicated by the directional arrows 9. The drilling fluid 26 lubricates the drill bit 105, carries formation cuttings up to the surface as it is returned to the pit 27 for recirculation, and creates a mudcake layer (not shown) on the walls of the borehole 11.

The example bottom hole assembly 100 of FIG. 1 includes, among other things, any number and/or type(s) of logging-while-drilling (LWD) modules or tools (one of which is designated by reference numeral 120) and/or measuring-while-drilling (MWD) modules (one of which is designated by reference numeral 130), a rotary-steerable system or mud motor 150 and the drill bit 105. The MWD module 130 measures the BHA 100 azimuth and inclination that may be used to monitor the borehole trajectory.

The example LWD tool 120 and/or the example MWD module 130 of FIG. 1 are housed in a special type of drill collar, as it is known in the art, and contain any number of logging tools and/or fluid sampling devices. The LWD tool 120 includes capabilities for measuring, processing and/or storing information, as well as for communicating with the MWD module 130 and/or directly with the surface equipment, such as, for example, a logging and control computer 160. The LWD tool 120 may implement embodiments of formation fracturing apparatus according to one or more aspects of the present disclosure.

The logging and control computer 160 may include a user interface that enables parameters to be input and or outputs to be displayed that may be associated with the drilling operation and/or the formation traversed by the borehole 11. While the logging and control computer 160 is depicted uphole and adjacent the wellsite system, a portion or all of the logging and control computer 160 may be positioned in the bottom hole assembly 100 and/or in a remote location. The LWD tool 120, the MWD tool 130 and the logging and control computer 160 can be used to implement embodiments of formation fracturing methods in accordance with one or more aspects of the present disclosure.

Figure 2:
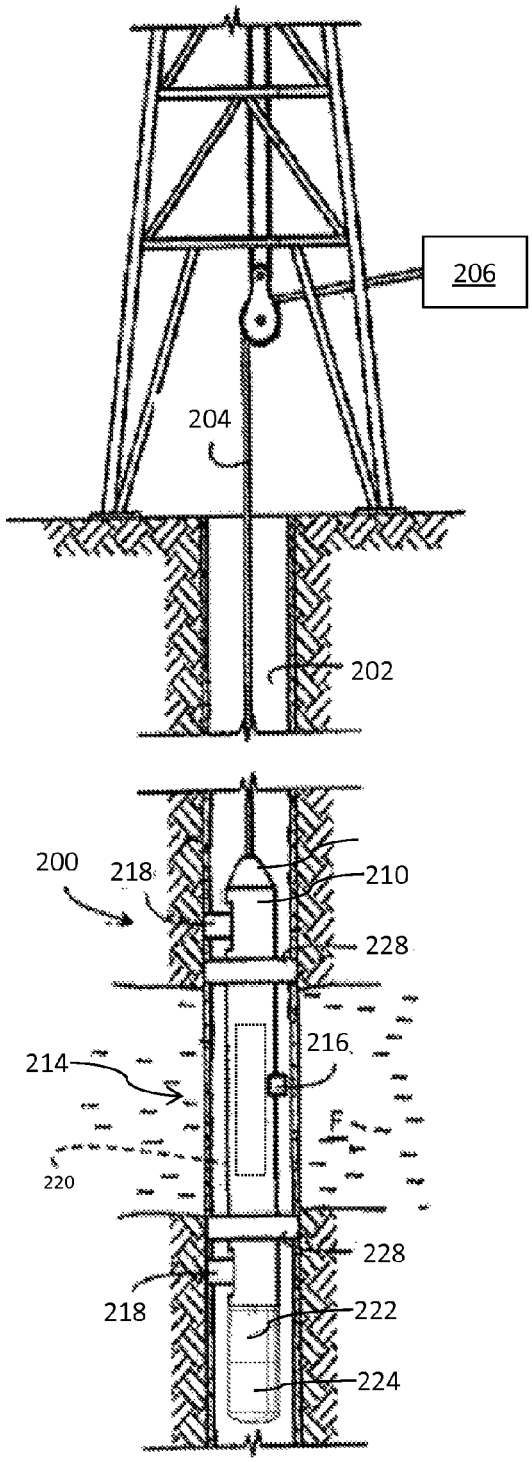
FIG. 2 illustrates an example wireline system in which embodiments of formation fracturing can be implemented.

Once a borehole has been drilled in a formation, such as shown in FIG. 1, the drill string 12 is removed from the borehole, and slickline, wireline or coiled tubing downhole tool(s) may be used to evaluate the surrounding formations and/or install a completion system to facilitate production of hydrocarbons. For example, a wireline system including downhole tool(s) according to one or more aspects of the present disclosure is depicted in FIG. 2. The example wireline tool 200 may be suspended in a borehole 202 from the lower end of a multiconductor cable 204 that is spooled on a winch (not shown) at the surface. At the surface, the multiconductor cable 204 is communicatively coupled to an electrical control and data acquisition system 206.

The wireline tool 200 includes a tool control system 210 to control fracturing of a formation F, store and/or analyze measurements performed during the fracturing of the formation F, a formation tester 214, and one or more fluid chambers 222 and 224, which may contain fracturing and/or inflation fluids. Although the downhole control system 210 and the one or more fluid chambers 222 and 224 are shown as being implemented separate from the formation tester 214, in some example implementations, the downhole control system 210 or the one or more fluid chambers 222 and 224 may be implemented at least partially in the formation tester 214.

The formation tester 214 includes selectively extendable probes 218, for example accelerometer or pressure probes. The extendable probes 218 may selectively extend towards portions of the wall of the borehole 202 to monitor the fracturing of the formation F. The formation tester 214 also includes a pump module 220 through which fracturing and/or inflation fluids are pressurized and thereafter expelled through ports, such as port 216, or used to inflate packers, such as packers 228 (only two of which are shown for simplicity). The fracturing and/or inflation fluids may be extracted from the one or more fluid chambers 222 and 224 or from the borehole 202. The fluid chambers 222 and 224 may have received the fluids at the surface and retained them for subsequent testing of the formation F.

In the illustrated example of FIG. 2, the electrical control and data acquisition system 206 and/or the tool control system 210 may be to operate the formation tester 214, for example selectively inflating the packers 228 to initiate fractures in the formation F, and/or controllably pressurizing the borehole interval sealed with the packers 228 to propagate the fractures in the formation F. In some example implementations, the tool control system 210 may drive the pressure or the flow rate generated by the pump module 220, and may analyze pressure measurement data acquired during fracturing. In other example implementations, the tool control system 210 may store the pressure measurement data and subsequently communicate the pressure measurement data to the electrical control and data acquisition system 206 for analysis.

While the modules or tools of FIG. 1 or 2 are described in the context of drilling or wireline systems, the example fracturing apparatus or fracturing methods according to the present disclosure are also applicable to any number and/or type(s) of additional and/or alternative downhole tools such as coiled tubing deployed tools.

Figure 3:
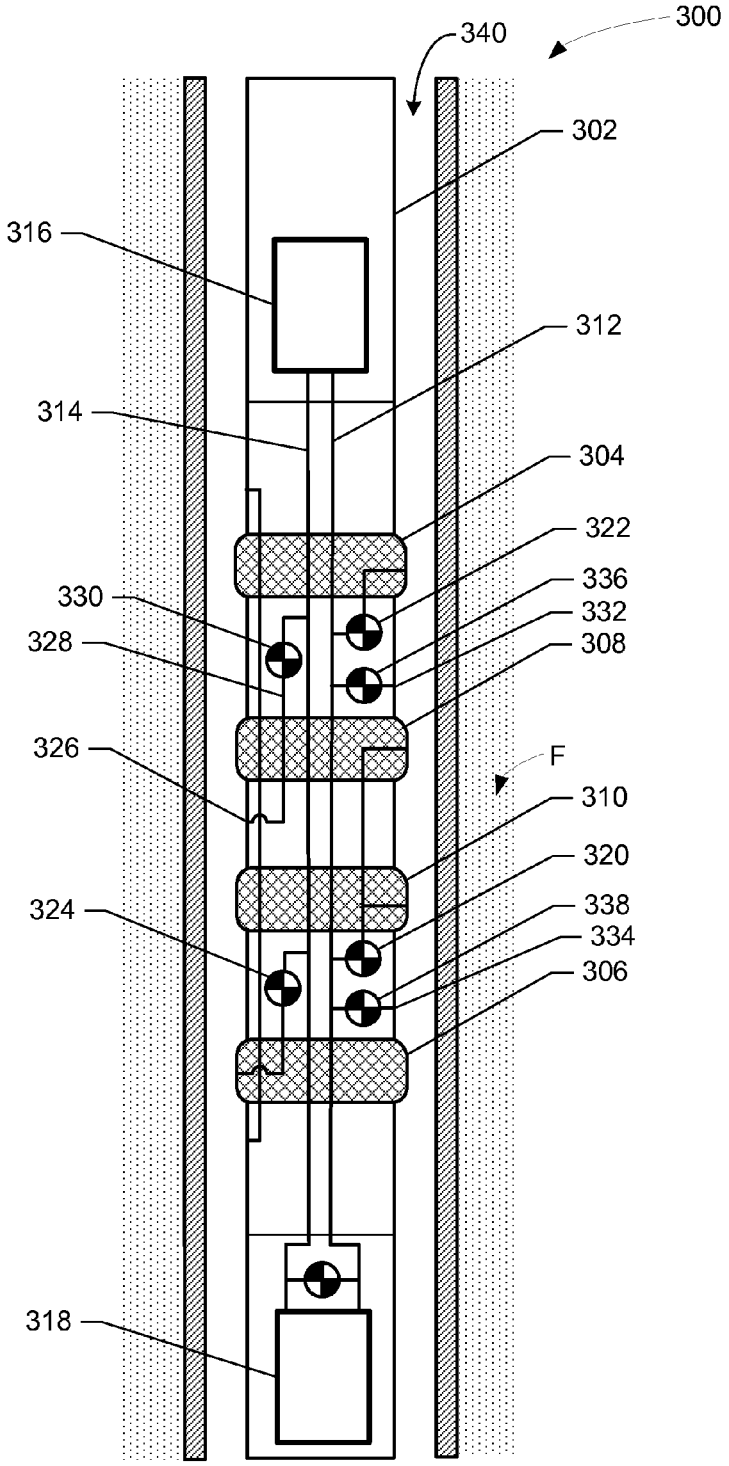
FIG. 3 illustrates an example device that can implement embodiments of formation fracturing.

One or more modules or tools of the example drill string 12 shown in FIG. 1 and/or the example wireline tool 200 of FIG. 2 may employ embodiments of fracturing apparatus and/or fracturing methods in accordance with one or more aspects of the present disclosure. For example, FIG. 3 is a schematic diagram of an example portion of a formation testing tool or formation tester 300 that may be used to implement one or more aspects of the present disclosure. The formation tester 300 shown in FIG. 3 may be used to implement, for example, portions of the tools shown in FIGS. 1 and/or 2.

The formation tester 300 includes a body 302 and a plurality of packers 304, 306, 308 and 310 spaced along the body 302. In the example of FIG. 3, the two outermost packers 304 and 306 surround the two inner packers 308 and 310 such that the inner packers 308 and 310 are located between the outermost packers 304 and 306. In other examples, one of the inner packers 308 and 310 may be eliminated or replaced with a dummy (i.e., a false) packer. Main flow lines 312 and 314 extend through the body 302 and may be coupled to one or more pumps 316 and 318 that may be used to convey fluids as described in more detail below. One of the main flow lines 312 and 314 is fluidly coupled to the inner packers 308 and 310 via a first valve 320 to enable fluid to be pumped into the inner packers 308 and 310 to inflate the inner packers 308 and 310. Similarly, the outermost packers 304 and 306 are fluidly coupled to the main flow lines 312 and 314 via respective valves 322 and 324 to enable fluid to be pumped into the outermost packers 304 and 306 to inflate the outermost packers 304 and 306.

The body 302 of the formation tester 300 also includes a sample port 326 that is coupled via a sample flow line 328 and a valve 330 to one of the main flow lines 312 and 314. Additionally, the body 302 includes guard ports 332 and 334 that are fluidly coupled to one of the main flow lines 312 and 314 via respective valves 336 and 338. In this particular example, there is one sample port located between the inner packers 308 and 310 and two guard ports located between respective ones of the outermost packers 304 and 306 and the inner packers 308 and 310. However, the number and locations of the ports may be varied to suit the needs of a particular application without departing from the scope of this disclosure. As shown in FIG. 3, the formation tester 300 may be lowered into a wellbore 340 to be at a location adjacent to a formation F. The formation tester 300 may be conveyed via a wireline, a drill string and/or any other conveyance.

While the valves 320, 322, 324, 330 and 338 shown in FIG. 3 are depicted in locations between the packers 304-310, some or all of these valves may instead be located above and/or below the outermost packers 304 and 306. In other words, in other examples, the formation tester 300 may be implemented so that no valves are located between any of the packers 304-310.

Figure 4:
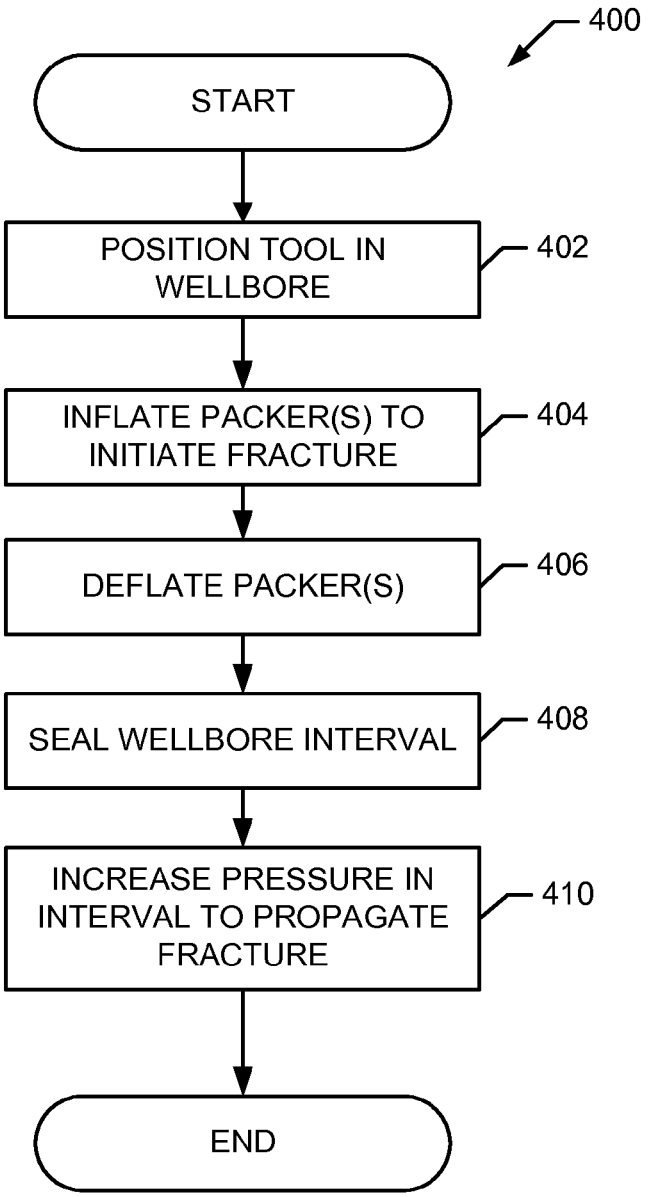
FIG. 4 illustrates example methods in accordance with embodiments of formation fracturing.

FIG. 4 is a flow diagram depicting an example process or method 400 that may be performed using the example fracturing apparatus according to the present disclosure. The example process or method 400 of FIG. 4 is described in connection with the example formation tester 300 of FIG. 3. However, the example method 400 of FIG. 4 may be applied for use with other apparatus such as tools having three packers, or three packers and a dummy packer substituted for one of the inner packers 308 and 310 shown in FIG. 3.

Now turning to FIG. 4 and with reference to FIG. 3, the method 400 begins by lowering or positioning the formation tester 300 to be located adjacent the formation F (block 402). With the formation tester 300 positioned in the location, the valve 320 is opened and fluid is pumped via one of the main flow lines 312 and 314 and one of more of the pumps 316 and 318 to inflate the inner packers 308 and 310 to mechanically initiate fracturing of the formation F (block 404). The inner packers 308 and 310 may then be deflated (block 406). The valve 320 is then closed and the valves 322 and 324 are opened to enable fluid to be pumped into the outermost packers 304 and 306 to inflate the outermost packers 304 and 306 to seal an interval of the wellbore 340 between the outermost packers 304 and 306 (block 408). The valves 322 and 324 are then closed and the valves 330, 336 and 338 are then opened and fluid is pumped via the main flow lines 312 and 314 and the ports 326, 332 and 334 into the sealed interval between the outermost packers 304 and 306 to increase the pressure in the sealed interval and hydraulically propagate the fracture (block 410). The fracturing method 400 of FIG. 4 is then ended and other fluid sampling or production associated with the fractured location of the formation F may be carried out as desired.

The method 400 of FIG. 4 is merely one example and, thus, other sequences of events or operations may be performed without departing from the scope of this disclosure. For example, the order of the blocks shown in FIG. 4 may be varied and/or one or more of the operations shown in FIG. 4 may be eliminated.

Figure 5:
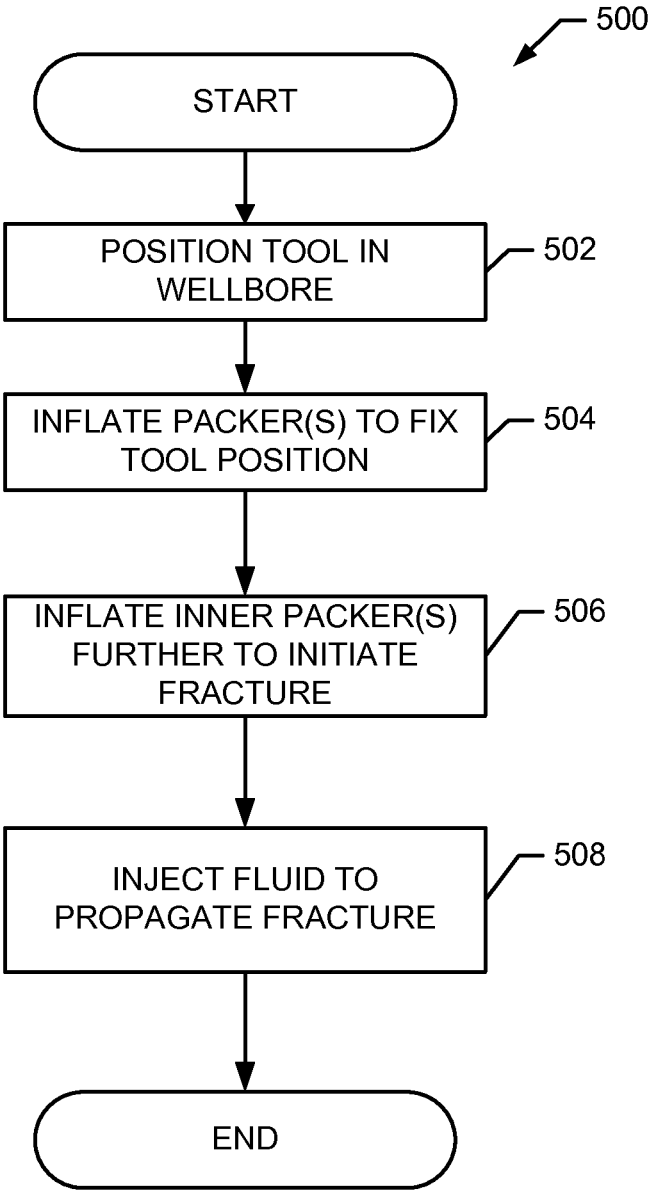
FIG. 5 illustrates example methods in accordance with embodiments of formation fracturing.

For example, FIG. 5 is another example process or method 500 that may be performed using the example fracturing apparatus according to the present disclosure. The example process or method 500 begins by lowering or positioning the formation tester 300 to be located adjacent the formation F (block 502). With the formation tester 300 positioned in the location, the outermost packers 304 and 306 are inflated to anchor the formation tester 300 in the location (block 504). In some examples, the inner packers 308 and 310 may also be inflated at block 504 to provide further anchoring of the formation tester 300 at the location. At block 504, the packers may all be inflated, at least initially, to a similar pressure (e.g., 500-1000 psi). Then, at block 506, the inner packers 308 and 310 are further inflated to a higher pressure to mechanically initiate a fracture of the formation F. During the inflation of the inner packers 308 and 310 at block 506, the ports 326, 332 and 334 may be opened via the valves 330, 336 and 338, respectively, to maintain hydrostatic pressure in the interval between the outermost packers 304 and 306. Following the mechanical fracturing of the formation by the inner packers 308 and 310, fluid is injected into the interval between the inner packers 308 and 310 to propagate the fracture (block 508). At block 508, fluid may also be injected into the intervals between the outermost packers 304 and 306 and the inner packers 308 and 310, thereby enabling a higher pressure (e.g., two times the differential pressure rating of the packers 304-310) to be applied in the interval between the inner packers 308 and 310. For example, if the differential pressure rating of each of the packers 304-310 is 4500 psi, then the guard intervals between the outermost packers 304 and 306 and the inner packers 308 and 310 can be pressurized to 4500 psi over hydrostatic pressure and the middle interval between the inner packers 308 and 310 can be pressurized to 9000 psi over hydrostatic pressure. Following the fracturing method 500 of FIG. 5, the inner packers 308 and 310 may be deflated and the interval between the outermost packers 304 and 306 may be sampled.

As can be appreciated, the foregoing disclosure introduces a method, comprising: lowering a tool into a wellbore adjacent a subterranean formation; inflating a first packer on the tool to initiate a fracture of the formation; inflating second and third packers on the tool to seal an interval of the wellbore containing the fracture, the first packer being between the second and third packers; and pumping fluid into the interval to increase a pressure in the interval to propagate the fracture. The inflating of the first, second and third packers may occur with the tool in the same location in the wellbore. The method may further comprise inflating a fourth packer on the tool to initiate the fracture, the fourth packer located between the second and third packers. The pumping of the fluid into the interval to increase the pressure in the interval may comprise pumping the fluid via at least one port of the tool, the at least one port located in the interval, and the pumping via the at least one port may comprise pumping the fluid via a sample port and a guard port. The pumped fluid may be a visco-elastic surfactant.

The foregoing disclosure also introduces a method, comprising: lowering a tool into a wellbore to be in a location adjacent a formation; mechanically initiating a fracture of the formation with the tool in the location; sealing an interval of the wellbore containing the fracture with the tool in the location; and increasing a pressure in the interval to propagate the fracture with the tool in the location. The mechanical initiation of the fracture may comprise inflating a packer or a plurality of packers on the tool. The sealing of the interval of the wellbore may comprise inflating a plurality of packers. The increasing of the pressure in the interval may comprise pumping fluid such as a visco-elastic surfactant into the interval. The pumping of the fluid into the interval may comprise pumping the fluid via a sample port and a guard port.

The foregoing disclosure also introduces an apparatus, comprising: a downhole tool having a body; a first packer and a second packer spaced along the body; a third packer between the first and second packers, the third packer being the only packer between the first and second packers; and a fluid port exiting the body of the tool between the first and second packers. The fluid port may be a sample port. The apparatus may further comprise a guard port on the body of the tool between the first and second packers. The apparatus may further comprise a dummy packer between the first and second packers. The apparatus may further comprise a first valve to control fluid flow via the fluid port and a second valve to control fluid flow to the first and second packers to inflate the first and second packers. The third packer may be inflated to initiate a fracture in a subterranean formation and the fluid port may be used to pressurize a wellbore interval between the first and second packers, when the first and second packers are inflated, to propagate the fracture. The apparatus may be conveyed via a wireline or a drill string.

Although only a few example embodiments have been described in detail above, those skilled in the art will readily appreciate that many modifications are possible in the example embodiments without materially departing from this disclosure. Accordingly, all such modifications are intended to be included within the scope of this disclosure as defined in the following claims. In the claims, means-plus-function clauses are intended to cover the structures described herein as performing the recited function and not only as structural equivalents, but also equivalent structures. Thus, although a nail and a screw may be not structural equivalents in that a nail employs a cylindrical surface to secured wooden parts together, whereas a screw employs a helical surface, in the environment of fastening wooden parts, a nail and a screw may be equivalent structures. It is the express intent of the applicant not to invoke 35 U.S.C. §112, paragraph 6 for any limitations of any of the claims herein, except for those in which the claim expressly uses the words "means for" together with an associated function.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A method, comprising:

lowering a tool into a wellbore adjacent a subterranean formation, the tool having first and second outer packers and first and second inner packers disposed between the first and second outer packers;

inflating the first and second outer packers to a first pressure to anchor the tool within the wellbore and seal a first interval of the wellbore extending between the first and second outer packers;

inflating the first and second inner packers to a second pressure, greater than the first pressure, to initiate a fracture of the formation and seal a second interval of the wellbore containing the fracture, wherein the second interval is disposed within the first interval between opposing first and second guard sections of the first interval;

pumping fluid into:

the first guard section of the first interval via a first port of the tool located between the first outer packer and the first inner packer;

the second guard section of the first interval via a second port of the tool located between the second outer packer and the second inner packer; and during the inflating of the first and second inner packers, opening a third port disposed on the tool between the first and second inner packers.

2. The method of claim 1 wherein inflating the first and second outer packers and the first and second inner packers occurs with the tool in the same location in the wellbore.

3. The method of claim 1, comprising:

opening the first port during inflation of the first and second inner packers to maintain hydrostatic pressure between the first inner packer and the first outer packer; and opening the second port during inflation of the first and second inner packers to maintain hydrostatic pressure between the second inner packer and the second outer packer.

4. The method of claim 1 comprising deflating the first and second inner packers and sampling fluid from the first interval.

5. The method of claim 1 wherein lowering comprises conveying the tool into the wellbore on a wireline or a drill string.

6. The method of claim 1 further comprising pumping fluid into the first and second guard intervals to increase a pressure in the first and second guard intervals to decrease a pressure differential between each of the first and second guard intervals and the second interval, thereby allowing the pressure in the second interval to be increased above the pressure in the first and second guard intervals.

7. The method of claim 1 wherein inflating the first and second inner packers is performed while the third port of the tool, located between the first and second inner packers, is kept open to allow fluid to escape from between the first and second inner packers to maintain hydrostatic pressure between the first and second inner packers.

8. The method of claim 1 wherein, during the inflating of the first and second inner packers, the first and second outer packers remain inflated at the first pressure to anchor the tool within the wellbore.

9. The method of claim 1 wherein the pumping the fluid occurs while the first and second outer packers remain inflated at the first pressure and while the first and second inner packers remain inflated at the second pressure.

10. The method of claim 1 comprising pumping the fluid into the second interval to increase a pressure in the second interval.

11. The method of claim 10 wherein pumping the fluid into the second interval to increase the pressure in the second interval comprises pumping the fluid via the third port of the tool.

12. A method, comprising:

lowering a tool into a wellbore adjacent a subterranean formation;

inflating a pair of outermost packers on the tool to a first pressure to anchor the tool within the wellbore and to seal a first interval of the wellbore extending between the pair of outermost packers;

inflating a pair of inner packers on the tool to a second pressure, greater than the first pressure, to initiate a fracture of the formation and to seal a second interval of the wellbore extending between the pair of inner packers; and during the inflating of the pair of inner packers, opening a sample port located between the pair of inner packers and opening two guard ports disposed between respective ones of the outermost packers and the inner packers to maintain hydrostatic pressure in the first interval extending between the pair of outermost packers.

13. The method of claim 12 comprising injecting fluid into the second interval to propagate the fracture.

14. The method of claim 13 wherein injecting the fluid into the second interval comprises pumping the fluid via at least one port of the tool, the at least one port located in the second interval.

15. The method of claim 12 wherein inflating the pair of outermost packers and the pair of inner packers occurs with the tool in the same location in the wellbore.

16. The method of claim 12 comprising injecting fluid into third and fourth intervals extending between respective ones of the outermost packers and the inner packers.

17. The method of claim 12 comprising deflating the pair of inner packers and sampling fluid from the first interval extending between the pair of outermost packers.

18. The method of claim 12 wherein lowering comprising conveying the tool into the wellbore on a wireline.

19. The method of claim 12 wherein lowering comprising conveying the tool into the wellbore on a drill string.

20. The method of claim 12 comprising inflating the pair of inner packers to a third pressure similar to the first pressure, prior to inflating the pair of inner packers to the second pressure, to further anchor the tool within the wellbore.

* * * * *